US009474122B2

(12) United States Patent
Kahlman et al.

(10) Patent No.: US 9,474,122 B2
(45) Date of Patent: Oct. 18, 2016

(54) CIRCUIT ARRANGEMENT AND LED LAMP COMPRISING THE SAME

(71) Applicant: KONINKLIJKE PHILIPS N.V., Eindhoven (NL)

(72) Inventors: Henricus Marius Joseph Maria Kahlman, Dongen (NL); Ralph Kurt, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/439,874

(22) PCT Filed: Sep. 17, 2013

(86) PCT No.: PCT/IB2013/058595
§ 371 (c)(1),
(2) Date: Apr. 30, 2015

(87) PCT Pub. No.: WO2014/072847
PCT Pub. Date: May 15, 2014

(65) Prior Publication Data

US 2015/0319818 A1 Nov. 5, 2015

Related U.S. Application Data

(60) Provisional application No. 61/722,847, filed on Nov. 6, 2012.

(51) Int. Cl.
*H05B 33/08* (2006.01)
*H05B 37/02* (2006.01)

(52) U.S. Cl.
CPC ..... *H05B 33/0851* (2013.01); *H05B 33/0845* (2013.01); *H05B 37/0209* (2013.01); *H05B 33/0809* (2013.01); *H05B 33/0812* (2013.01); *H05B 33/0818* (2013.01)

(58) Field of Classification Search
CPC ..... H05B 41/16; H05B 33/0815; H05B 33/0887; H05B 33/08; H05B 33/0851; H05B 37/0209
USPC ..... 315/297, 247, 185 S, 291, 312, 224, 315/201, 287, 200 R, 209 R, 299, 307–308
See application file for complete search history.

(56) References Cited

U.S. PATENT DOCUMENTS 7,081,722 B1 7/2006 Huynh et al.
8,674,605 B2 * 3/2014 Puvanakijjakorn H05B 33/0809 315/200 R (Continued)

FOREIGN PATENT DOCUMENTS

WO 2012007797 A1 1/2012
WO 2012016197 A1 2/2012

OTHER PUBLICATIONS

"Sequential Linear LED Driver", Supertex Inc., CL8800, www.supertex.com.

*Primary Examiner* — Thai Pham
*Assistant Examiner* — Wei Chan

(57) ABSTRACT

A circuit arrangement for operating at least one low-power lighting unit with a phase-cut operating voltage from a power supply is disclosed, which circuit arrangement comprises a serial setup of an input device (6), a two-port power shaping circuit (7, 7', 7") and a lamp driver unit (8, 8', 8"). The power shaping circuit (7, 7', 7") comprises at least a bleeder (13) and a damping circuit (14). While the bleeder circuit (13) provides an alternative current path to set a global current, drawn during operation from the power supply to a predefined minimum load current, the damping circuit (14) serves to attenuate high frequency oscillations in said operating voltage. To enhance dimmer compatibility and simultaneously provide a cost-efficient circuit setup, a first and a second feedback circuit (18, 25) is provided, allowing to control the bleeder circuit (13) and the lamp driver unit (8, 8', 8") according to a two-point control.

20 Claims, 4 Drawing Sheets

(56) References Cited

U.S. PATENT DOCUMENTS

| | | | | |
|---|---|---|---|---|
| 9,113,521 | B2 * | 8/2015 | Gredler | H05B 33/0815 |
| 2003/0223255 | A1 * | 12/2003 | Ben-Yaakov | H02M 1/4225 363/89 |
| 2008/0048573 | A1 | 2/2008 | Ferentz et al. | |
| 2010/0026208 | A1 * | 2/2010 | Shteynberg | H05B 33/0815 315/297 |
| 2011/0140622 | A1 | 6/2011 | Suzuki | |
| 2011/0227489 | A1 | 9/2011 | Huynh | |
| 2011/0248640 | A1 | 10/2011 | Welten | |
| 2011/0309759 | A1 * | 12/2011 | Shteynberg | H05B 33/0815 315/201 |
| 2012/0025729 | A1 * | 2/2012 | Melanson | H05B 33/0815 315/224 |
| 2012/0025733 | A1 * | 2/2012 | Melanson | H02M 1/36 315/287 |
| 2012/0043913 | A1 * | 2/2012 | Melanson | H05B 33/0815 315/307 |
| 2012/0086361 | A1 | 4/2012 | Darshan | |

* cited by examiner

CIRCUIT ARRANGEMENT AND LED LAMP COMPRISING THE SAME

CROSS-REFERENCE TO PRIOR APPLICATIONS

This application is the U.S. National Phase application under 35 U.S.C. §371 of International Application No. PCT/IB13/058595, filed on Sep. 17, 2013, which claims the benefit of U.S. Provisional Patent Application No. 61/722,847, filed on Nov. 6, 2012. These applications are hereby incorporated by reference herein.

TECHNICAL FIELD

The present invention relates to a circuit arrangement for operating at least one low-power lighting unit with a phase-cut operating voltage, a LED lamp comprising the same and a method of operating a low-power lighting unit.

BACKGROUND ART

In the field of lighting, present efforts aim for reducing the power consumption in particular of residential and commercial lighting applications. Nowadays, lamps or light sources are being employed for the replacement of common incandescent or halogen lamps, which include one or more light emitting diodes (LEDs). LEDs feature a dramatically decreased power consumption in comparison to incandescent lamps with the same luminous flux and in addition provide a substantially increased lifetime. LEDs thus are very promising for new generation light sources.

For retrofit applications however, i.e. as a replacement for incandescent or halogen lamps, LEDs typically cannot be used directly with common types of installed power supplies, but due to its exponential voltage-current behavior, require a dedicated driver circuit. The LED driver circuit usually adapts the voltage for the LED to the requisite level and also keeps the delivered current constant. A most simple "driver circuit" comprises a resistive element in series with the LED(s).

A particular problem may arise from the fact that the reduced power consumption of LEDs results in an accordingly reduced operating current. In particular when using the LED lamp with a power supply having a phase-cut dimming unit, such as a leading-edge or trailing-edge dimming unit, the power supply may have a minimum load requirement, which may not be met by the LED lamp. Here, the reduced current may result in an unintended behavior of the dimmer/lamp combination, which may e.g. result in visible flicker.

For example, since a trailing-edge (TE) type of dimmer typically is MOSFET-based and comprises an internal supply circuit which powers the timing and zero-crossing detection circuit, the "under-load" may result in that the internal supply cannot provide enough operating power to the timing circuit, causing problems with the zero-crossing detection of the sinusoidal mains voltage. In a leading-edge (LE) type of dimmer, a TRIAC or two anti-parallel connected thyristors are used, where the current typically needs to be high enough to maintain the TRIAC in a conductive state, i.e. above a holding current, so that the operation of a LED lamp with this type of power supply or dimmer may result in an "unintended" or untimely disconnect of the TRIAC(s).

An object of the present invention therefore is to provide a circuit arrangement, which allows operating at least one low-power lighting unit with a phase-cut operating voltage, so that it is possible to operate said lighting unit with a variety of types of power supplies while maintaining high quality light output. A further object is to provide a cost-efficient circuit arrangement, which allows to be used for mass market applications.

DISCLOSURE OF INVENTION

According to the present invention, the object is solved by a circuit arrangement, an LED lamp, a lighting system and a method of operating at least one low-power lighting unit with a phase-cut operating voltage according to the independent claims. The dependent claims relate to preferred embodiments of the invention.

The basic idea of the present invention is to provide a circuit arrangement having a cascaded, i.e. serial multi-stage set-up to provide for a cost-efficient design while simultaneously provide high compatibility in particular to power supplies having dimmers.

The circuit arrangement according to the invention comprises at least an input device, a power shaping circuit and a lamp driver unit in a serial connection.

The power shaping circuit comprises a controllable bleeder circuit in series with a damping circuit. The bleeder circuit provides that the global current, i.e. the current drawn from the power supply during operation, corresponds to a predefined minimum load current to provide an enhanced compatibility to various types of power supplies and in particular such providing a phase-cut operating voltage, e.g. comprising a phase-cut dimmer. The damping circuit attenuates high-frequency oscillations, which may occur at each edge of the phase-cut operating voltage to allow high-quality light output.

The lamp driver unit is configured to control a lamp current of at least one low-power lighting unit to a setpoint current based on a first feedback signal.

Accordingly, the cascaded multi-stage setup allows on the one hand to keep the current provided to the lamp, i.e. the lamp current, constant while at the same time provide that the global current, drawn during operation on the power supply, corresponds to the predefined minimum load current, e.g. of the power supply. The present invention thus advantageously allows setting both, the input and the output current to the respectively desired setting independently from each other, enabling a two-point control.

The inventive circuit arrangement is adapted for operating at least one low-power lighting unit with a phase-cut operating voltage from a power supply, as discussed before.

The low-power lighting unit may be of any suitable type. Preferably, the low-power lighting unit is an LED unit comprising at least one light emitting diode (LED), which in terms of the present invention may be any type of solid state light source, such as an inorganic LED, organic LED or a solid state laser e.g. a laser diode. The LED unit may certainly comprise more than one of the before mentioned components connected in series and/or in parallel. The term "low-power" relates to the power consumption of the lighting unit compared to that of a conventional light source like an incandescent lamp. The power consumption of the at least one lighting unit is preferably below 20 W, more preferably below 15 W, most preferably below 10 W.

The phase-cut operating voltage is a sinusoidal voltage, where a part of each wave/cycle (or usually each half-wave/half-cycle) is chopped or cut out. Starting from zero-crossing of the sinusoidal or alternating voltage, this may be the leading-edge part or the trailing-edge part.

Although the power supply in this context usually comprises a "dimmer", e.g. a phase-cut dimmer, sometimes also referred to as "phase firing controller", in the sense that the part of the wave that is chopped—which corresponds to the timing of the phase-cut—can be adjusted by a user, it is also conceivable that this part is constant. Anyway, the time evolution of the voltage shows a comparably steep decline or rise on each phase-cut operation. Any phase-cut technology known in the art may be used in the context with the present invention. However, the inventive circuit is particularly suitable for use with a power supply having a leading-edge (LE) type of dimmer.

As mentioned before, the inventive circuit arrangement comprises an input device, a two-port-power shaping circuit and a lamp driver unit, which are connected in a cascaded, i.e. serial three stage set-up.

The input device is adapted for connection to the power supply, e.g. over suitable (detachable) connecting terminals, and comprises at least a first and a second supply (output) terminal. The two-port power shaping circuit comprises a first and a second input terminal and a first and a second output terminal. The output terminals are connected with said input terminals over a first and a second supply connection.

Each of the before mentioned terminals may be connected by a permanent electrical connection, for example by soldering, or by a detachable connection, like a plug and a socket connection. The terminals should provide an electrically conductive connection at least in an operational state of the circuit arrangement.

Any electrical connections mentioned in the context of the present invention may be switchable and furthermore may be indirect, i.e. comprising intermediate components, but are preferably direct.

The power shaping circuit according to the invention comprises a controllable bleeder circuit, connected between the first and second input terminals to provide an alternative current path. As mentioned in the preceding, the bleeder circuit is configured to set the global current, drawn during operation from the power supply, to a predefined minimum load current.

The controllable bleeder circuit thus allows setting the global current, i.e. the current drawn from the power supply through the first and second supply terminals of the input device, to the predefined minimum load current and independent from the further components of the circuit arrangement. In the present context, the bleeder circuit may provide that the global current corresponds at least to the minimum load current. Certainly, the global current may be set higher than the minimum load current. However a higher current may reduce the efficiency of the circuit arrangement.

The predefined minimum load current may be set permanently in the bleeder circuit, provided by an external signal and/or may be controllable by a user using a correspondingly adapted user interface, a switch or a potentiometer for individual adaptation to the requirements of the respective power supply. The predefined minimum load current preferably corresponds to the minimum hold current of the power supply/dimmer, wherein the term "corresponds" includes a current setting, slightly higher than the minimum hold current, i.e. in a range of less than 15% higher than the minimum hold current of the dimmer. The minimum load current may be as high as 50 mA, but preferably is 20 mA, most preferred 22 mA and particularly preferred 35 mA.

The controllable bleeder circuit may be of any suitable type. For example, the bleeder circuit may comprise a variable resistor to set the current between the first and second input terminals. Preferably, the bleeder circuit comprises a controllable current source or an adaptive current source. Herein, the term "adaptive current source" relates to a current source, where the amplitude/on-time of the current drawn is controlled in dependence of the dim level, the dim curve, lamp current and/or minimum load current. Most preferably, the bleeder circuit comprises a controllable clamp circuit to set the potential to ground potential in an off-state of the dimmer to allow a large current of approximately 200 mA. The bleeder circuit may comprise control circuitry of any suitable type, e.g. discrete and/or integrated electronic circuitry, and may comprise a microcontroller and/or one or more comparators.

As mentioned above, the power shaping circuit furthermore comprises a damping circuit, connected to the first and the second supply connection of the power shaping circuit at a first and second connection point. Thus, the damping circuit is coupled to "intermediate" connection points in series with input and output terminals. The damping circuit is arranged to damp or attenuate high-frequency oscillations, i.e. typically in the range of 8 kHz-10 kHz for dimmers operated at 50 Hz mains frequency and between 10-100 kHz for dimmers operated at 60 Hz mains frequency, which may be present in the phase-cut operating voltage and in particular at the before mentioned dimmer edge. It is particularly important, that the damping circuit is arranged between the bleeder circuit and the output terminals, i.e. the lamp driver unit in the mentioned serial arrangement, so that the operation of the two circuits does not interfere with the respective other circuit.

The damping circuit may be of any suitable type and preferably comprises a RC circuit. For example, the damping circuit may be a resistive/capacitive network, i.e. a combination of one or more resistor and capacitor. Preferably, the damping circuit is configured to draw an additional current from the power supply at or shortly after the phase-cut operation, i.e. the before mentioned steep decline or rise, caused by the phase-cut dimmer. Most preferably, the damping circuit is non-dissipative and comprises an energy storage device, such as a capacitor. Herein, the term "non-dissipative" is understood that the drawn current is substantially provided to further components of the circuit arrangement and in particular to a power supply and/or the lamp driver unit, e.g. at a different phase-angle or half-cycle of the phase-cut operating voltage.

The inventive circuit arrangement further comprises the lamp driver unit, which is connected to at least one of the output terminals of the power shaping circuit and is configured for connection to the at least one low-power lighting unit. The lamp driver unit comprises at least a controllable lamp current controller, such as a controllable/adaptive current source, which is configured to control the lamp current of said at least low-power lighting unit. In the present context, the term "lamp current" is understood as the current flowing through the at least one low-power lighting unit in an operational state of the circuit arrangement.

The lamp driver unit furthermore comprises a first feedback circuit, configured to provide a first feedback signal which corresponds to the momentary lamp current of the low-power lighting unit. The lamp current controller is connected with the feedback circuit to control the lamp current in dependence of the first feedback signal, so that the lamp current corresponds to a given setpoint current, i.e. to maintain the lamp current substantially constant (+/−0.5 mA~1%) in a closed-loop operation.

The feedback circuit and the lamp current controller may be of any suitable type to determine the momentary lamp current and control the lamp current accordingly. The lamp current controller may comprise a control circuit, e.g. discrete and/or integrated circuitry, such as a micro-controller or a suitable set-up of one or more comparators. The feedback circuit may be formed by any suitable circuitry. Preferably, the feedback circuit is of analog type, i.e. the feedback circuit provides an analog signal, corresponding to the lamp current, allowing a cost-efficient setup of the circuit arrangement.

Certainly, the feedback circuit may be formed integrated, e.g. as part of an analog and/or digital integrated circuit device (IC). The first feedback circuit may also be formed integrated with further components, e.g. the above mentioned lamp current controller. This may be particularly advantageous in case the lamp current controller is a switch mode power supply as discussed in the following. Here, the feedback circuit may be formed integrated with the IC that also controls the switch mode.

The setpoint current may be predefined, e.g. in dependence of the respective type of low-power lighting unit connected or may be set externally, e.g. by a user or according to the respective dim level of the phase-cut operating voltage, which will be explained in detail further below.

The lamp driver unit may be suitably adapted to control the current through the at least one low-power lighting unit, e.g. comprising one or more controllable current sources. For example, the lamp driver unit be a switch mode power supply, such as a buck, buck-boost, flyback of halfbridge converter. As will be apparent to one skilled in the art, a switch mode power supply circuit typically comprises a switching device and an energy storage, which is charged and discharged in cycles to adapt the voltage and/or current according to the application. The lamp driver unit in particular in this case may comprise a EMI filter circuit to attenuate high-frequency ripple, caused by the operation of the switching device of the switch mode power supply circuit, for example a PI filter (capacitor/inductor filter). The lamp driver unit may further comprise a buffer/fill-in stage, such as one or more suitably connected capacitors.

Alternatively or additionally, the lamp driver unit may comprise a tapped linear driver, e.g. comprising multiple controllable current sources for the operation of an according number of low-power lighting units, e.g. LEDs.

As discussed in the preceding, the lamp driver unit is connected to at least one of the output terminals of the power shaping circuit. The lamp driver unit may preferably be connected between one of the output terminals and a reference potential, such as ground potential. Certainly, the lamp driver unit may further preferred be connected to both of the output terminals of the power shaping circuit. In this case, it follows that the at least one low-power lighting unit is connected between the first and the second output terminals of the power shaping circuit.

During operation of the inventive circuit arrangement, the lamp current is regulated by the current controller according to the desired setpoint current in a closed-loop operation. According to the inventive setup, this control is conducted in the lamp driver unit, i.e. the "third stage" of the circuit arrangement. Independently there from, the before mentioned bleeder circuit of the power shaping circuit, i.e. the "second stage", maintains the global current at the desired minimum load current. The inventive circuit arrangement thus provides a "two-point" control in a cascaded or serial setup, which is particularly cost-efficient and allows improved control and compatibility in particular for low-cost mass market applications.

Preferably, the bleeder circuit is configured to be activated only when the global current is lower than the predefined minimum load current. Since according to the above, the bleeder circuit may e.g. be of dissipative type, the present embodiment enhances the energy efficiency of the circuit arrangement further, since the bleeder is only activated, i.e. controlled to provide said current path between the input terminals, when the lamp driver unit and the at least one low-power lighting unit does not draw enough current to maintain the global current at the predefined minimum load current.

Certainly, it should be mentioned that the damping circuit depending on its design may also draw a minor current during its operation, so that it should be understood that the bleeder circuit may be configured to be activated only when the sum of the lamp current and the current drawn by the damping circuit is below the minimum load current. However, the current, drawn by the damping circuit typically is negligible.

As discussed above, the bleeder circuit may be of any suitable type to set the global current, drawn during operation from the power supply, to the predefined minimum load current.

According to a preferred embodiment of the invention, the circuit arrangement, e.g. the power shaping circuit, further comprises a second feedback circuit, configured to determine a second feedback signal corresponding to the momentary global current and to provide set second feedback signal to the bleeder circuit.

According to the present embodiment, a second feedback circuit or loop is provided to allow setting the global current corresponding to the predefined minimum load current during normal operation. Preferably, the second feedback circuit is also of analog type, i.e. the second feedback circuit provides an analog signal, corresponding to the global current. The setup of the first and second feedback circuit may be identical, e.g. of analog type.

The present embodiment may be particularly advantageous when the circuit arrangement is used for low-cost lighting applications, since the provision of analog feedback circuits results in a very cost efficient design.

As discussed above, the first and the second feedback circuit may be of any suitable type for determining the first and second feedback signals, corresponding to the momentary lamp current and the global current, respectively. The second feedback circuit may also be formed integrated as discussed above with reference to the first feedback circuit. In case that both the first and second feedback circuits are formed as integrated circuits, it is preferred that the feedback circuits are integrated in one IC.

Most preferably, the bleeder circuit is configured to maintain the global current substantially constant in the range of 20 to 50 mA during most of the conduction interval, i.e. when using an LE dimmer, the time in each half cycle between the dimmer edge and the subsequent zero-crossing of the phase-cut operating voltage.

According to a further preferred embodiment of the invention, the first and/or second feedback circuits are coupled to a series connection of a first and a second current sensing resistor, said series connection being coupled between said second supply terminal and a reference potential. Preferably, the reference potential is ground.

As will be apparent to one skilled in the art, the voltage, determined at a sensing resistor, corresponds to the current flowing through it, so that the use of sense resistors allows providing a feedback signal with a particularly cost-efficient circuit setup. The provision of at least two sense resistors in series, which form a voltage divider circuit between the second supply terminal of the input device and the reference potential, is particularly advantageous for an efficient determination of the momentary global current and the momentary lamp current.

During operation, the presence of the first and second sensing resistors "shifts" the voltage at the second supply terminal in respect to the reference potential. Thus, a current flows between the supply terminal and the reference potential through said first and second sensing resistors. This shift and the respective current depends on the current though the further components, e.g. the at least one low-power lighting unit.

Advantageously, the present embodiment thus does not necessitate to determine the current at the lamp driver directly, where the presence of sensing resistors would cause power dissipation.

The current sensing resistors may be of any suitable type and may comprise one or more resistive elements. The setup of the sensing resistors may comprise one or more zener diodes or transistors for adaptation of the voltage levels. The reference potential may be chosen according to the application. Preferably, the reference potential is a ground potential.

The first feedback circuit may most preferably be connected to a current sensing point between said first and second current sensing resistors to determine said first feedback signal, i.e. corresponding to the momentary lamp current.

Most preferably, the second feedback circuit is connected with said second supply terminal of said input device to determine a second feedback signal, corresponding to the momentary global current.

According to a further development of the invention, the second output terminal of the power shaping circuit is connected to the reference potential, e.g. ground potential. Additionally or alternatively, the first current sensing resistor is connected in series between said second input terminal and said second output terminal of the power shaping circuit, i.e. in the second supply connection. Alternatively or additionally, the second current sensing resistor may preferably be arranged in series between said second supply terminal and said second input terminal.

Due to the resulting connection of the bleeder circuit to the second input terminal of the power-shaping circuit, i.e. "between" the sensing resistors, the current through and thus the voltage over the second sensing resistor, i.e. the resistor between the second supply terminal and the power-shaping circuit includes the current, drawn by the bleeder circuit. Accordingly, the voltage over the second sensing resistor corresponds to the momentary global current, while the voltage over the first sensing resistor corresponds to the momentary lamp current.

From the above, it will become apparent that two possibilities exist with regard to the positioning of the first sensing resistor between the second input and output terminals. The resistor may be placed either between the first input terminal of the power shaping circuit and the second connection point of the damping circuit, i.e. "between" bleeder and damping circuit, or between the second connection point and the second output terminal. According to the above first alternative, any additional current drawn by the damping circuit does not influence the first feedback signal. However, by placing the resistor between damping circuit and output terminal, the first feedback signal corresponds to the combined current drawn by the lighting unit and the damping circuit. The latter is particularly advantageous when a relatively constant global current is desired. The specific arrangement certainly depends on the application.

Preferably, the lamp driver unit is connected between said first output terminal of the power shaping circuit and said reference potential, e.g. ground potential.

Most preferably, the input device comprises a full-bridge rectifier, wherein a positive output of said rectifier is connected to said first supply terminal and a negative output of said rectifier is connected to said second supply terminal.

The present embodiment advantageously allows to operate the circuit arrangement directly with a sinusoidal or alternating mains voltage, resulting in an enhanced versatility.

According to a further development of the invention, the damping circuit is adapted, so that upon detection of a dimmer edge, the global current is controlled to an increased edge current, higher than said predefined minimum load current. Preferably, the peak edge current is higher than 10% of the predefined minimum load current.

Due to increased current at or shortly after the dimmer edge, e.g. approx. 200 microseconds after the edge, oscillations, caused by the dimmer edge are advantageously suppressed or at least substantially reduced. Such oscillations may cause the global current to drop significantly and in particular below the minimum hold current of the power supply, which should be avoided.

For reasons of energy efficiency, the edge current should be applied during a short period only, i.e. an edge current pulse. Preferably, the edge current pulse has a duration of 100-500 μs FWHM, preferably between 150-300 μs FHWM.

As discussed in the preceding, the damping circuit may comprise capacitive elements. To avoid that upon operation of the bleeder circuit, any capacitive elements of the damping circuit or the lamp driver unit are discharged, it is particularly preferred that a current flow restrictor is connected between the first input terminal and the first connection point of the damping circuit with the first supply connection, i.e. between the bleeder and damping circuits. The flow restrictor may be of any suitable type and preferably comprises at least a flow restricting diode.

Most preferably, a second current flow restrictor may be connected between the connection point of the damping circuit and the first output terminal, i.e. the lamp driver, so that current flow from the lamp driver to the damping circuit is avoided.

To obtain the above mentioned setpoint current for the controllable lamp current controller, it may be desired to set the current in dependence of a dim level of the phase-cut operating voltage, i.e. according to the dimmer knob setting of the connected phase-cut power supply. As will become apparent to one skilled in the art, in a phase-cut dimmer, the dim level corresponds to the conduction interval, i.e. time between the dimmer edge and the following zero-crossing of the phase-cut operating voltage, so that determination of the conduction interval in at least one half-cycle of the sinusoidal operating voltage allows to easily retrieve the dim setting.

Accordingly and particularly preferred, the circuit arrangement further comprises a dim level detector, configured to determine a dim level from said phase-cut operating voltage, said dim level detector being connected with said lamp current controller to set the setpoint current in dependence of the determined dim level.

The dim level detector may be of any suitable type and preferably comprises an edge detector and a zero-crossing detector, so that the setpoint current is controlled to correspond to the length of the conduction interval between the zero-crossing and the detected edge or between the edge and the subsequent zero-crossing. Alternatively or additionally, the dim level detector may be adapted to integrate the rectified operating voltage. In this case, the integrated operating voltage corresponds to the dim level.

Most preferably, the dim level detector is integrated with the input device and/or the two-port power shaping circuit.

A further aspect of the present invention relates to an LED lamp comprising a circuit arrangement corresponding to one or more of the above mentioned embodiments and at least one LED-unit connected to the circuit arrangement, i.e. to the lamp driver unit of the circuit arrangement. The LED unit here may be of any suitable type as mentioned in the proceeding. Most preferably, the at least one LED unit and the circuit arrangement are comprised in common housing of the LED lamp.

BRIEF DESCRIPTION OF THE DRAWINGS

These and other aspects, features and advantages of the present invention will be apparent from and elucidated with reference to the description of preferred embodiments in conjunction with the enclosed figures, in which.

DESCRIPTION OF EMBODIMENTS

Figure 1:
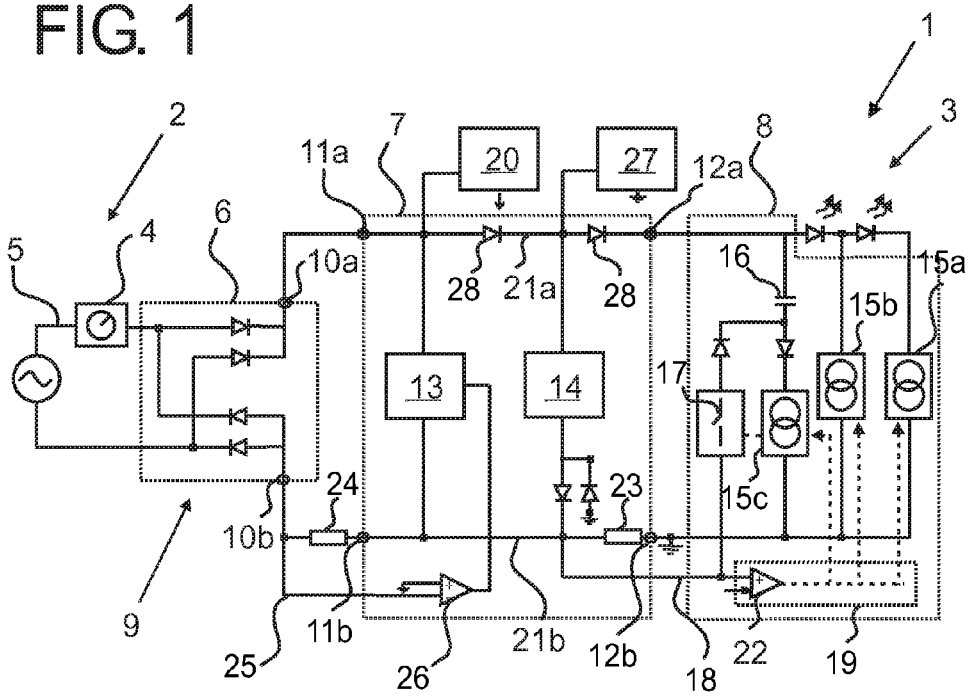
FIG. 1 illustrates a first embodiment of a circuit arrangement according to the invention in a schematic block diagram.

FIG. 1 shows a first embodiment of the inventive circuit arrangement 1 in a schematic block diagram. To facilitate understanding of the present invention, circuit arrangement 1 in FIG. 1 is shown in an operational state, i.e. connected to a phase-cut power supply 2 and two high voltage LEDs 3. The power supply 2 comprises a leading-edge (LE) dimmer 4 connected with a power source, e.g. mains 5. The power supply 2 accordingly provides a phase-cut operating voltage to the circuit arrangement 1, i.e. an alternating voltage, where a part of each half cycle is chopped or cut out during a dimming operation of dimmer 4. Since dimmer 4 is of LE type, the chopped part is the front part of the waveform of the operating voltage in each half cycle. The LEDs 3 emit white light and have a power consumption of approx. 9 W. A lamp housing with a typical socket connection (both not shown) is provided to accommodate the circuit arrangement 1 and the LEDs 3.

Circuit arrangement 1 comprises an input device 6, a two-port power shaping circuit 7 and a lamp driver unit 8, which according to FIG. 1 are arranged in a cascaded, i.e. serial connection.

The input device 6 serves to connect the further components of the circuit arrangement 1 and the LEDs 3 with the power supply 2 over a typical plug/socket connection (not shown) and thus to provide power. The input device 6 according to FIG. 1 comprises a typical diode bridge rectifier 9 adapted to provide a rectified phase-cut operating voltage between a first supply terminal 10*a* and a second supply terminal 10*b*. The supply terminals 10*a*, 10*b* are connected with the power shaping circuit 7, i.e. with first and second input terminals 11*a*, 11*b* of the power shaping circuit 7.

The power shaping circuit 7 comprises a first 21*a* and a second 21*b* supply connection, which connect the first and second input terminals 11*a*, 11*b* with first and second output terminals 12*a*, 12*b*, respectively. The power shaping circuit 7 further comprises a bleeder circuit 13 and a damping circuit 14, connected between the supply connections 21*a* and 21*b*, the operation of which is explained in detail in the following.

The first 12*a* and a second 12*b* output terminals of the power shaping circuit 7 are connected with the lamp driver unit 8 to provide operating power to the two LEDs 3. The lamp driver unit 8 according to the present embodiment is a tapped linear driver comprising controllable current sources 15*a*, 15*b* and 15*c*. As can be seen, the controllable current sources 15*a* and 15*b* are connected in series to the LEDs 3 in a typical tapped linear driver configuration, so that the LEDs 3 are subsequently provided with power when the applied voltage is high enough to set the respective LED 3 to a conductive mode.

Current source 15*c* is connected in series with a "fill-in"-buffer capacitor 16 to provide that the fill-in capacitor 16 is maintained a suitable level.

The "fill-in" capacitor 16 allows to power the LEDs 3 even when the voltage applied is lower than the voltage of one of the LEDs 3, which assures at least one of the LEDs 3 is provided with power over the entire half cycle of the phase-cut operating voltage and thus provides that the light output is substantially constant and does not show visible flicker. Switch 17 allows to discharge the "fill-in" capacitor 16 if necessary.

The lamp driver unit 8 further comprises a lamp current controller 19. Lamp current controller 19 comprises a comparator 22 and is connected to control the current sources 15*a*-15*c* and switch 17, as shown in FIG. 1 by the dashed lines. The lamp current controller 19 serves to control the current(s) through the LEDs 3. The lamp current controller 19 is connected to a first feedback circuit 18 to receive a first feedback signal, corresponding to the momentary lamp current and to dim level detector 20 to receive a dim signal, corresponding to the setting of LE dimmer 4. For reasons of clarity, the connection between dim level detector 20 and the comparator 22 of the lamp current controller 19 is indicated by arrows.

The dim level detector 20 is configured to derive the dim signal from the rectified phase-cut voltage and thus is connected to first supply connection 21*a*.

The lamp current controller 19 compares the momentary lamp current, as provided by first feedback circuit 18 and the dim signal to set the current sources 15*a*-15*c* and thus the brightness of the LEDs 3 to correspond to the dim signal. As will be apparent to one skilled in the art, the lamp current controller 19 thus provides closed-loop operation to set the lamp current in accordance with the dim signal, i.e. a "setpoint current", i.e. according to the present embodiment +−0.5 mA, ~1% of the desired setting so as to provide that the lamp current closely "matches" the dim setting.

As can be seen from the figure, the first feedback circuit 18 is connected to the second supply connection 21*b*, i.e. to a current sensing point between first current sensing resistor 23 and second current sensing resistor 24.

The power shaping circuit 7 comprises, as mentioned in the preceding, bleeder circuit 13. The bleeder circuit 13 serves as a further current path between the first and second supply connection 21*a*, 21*b* to enhance the compatibility with typical dimmers, such as LE dimmer 4. Since corresponding types of dimmers typically show a minimum load/hold current to keep the dimmer in a conductive state, the bleeder circuit 13 draws current in addition to the lamp driver unit 8 when the current drawn by the driver unit 8 is below a predefined minimum load current. This may be particularly the case at relatively low dimming levels due to the reduced current consumption. Bleeder circuit 13 comprises a controllable current source (not shown) and is connected with a second feedback circuit 25, which is connected to the second supply terminal 10*b* of the input device 6 to obtain a second feedback signal, corresponding to the overall, i.e. the momentary global current. Comparator 26 serves to invert the polarity of the second feedback signal.

The power shaping circuit 7 further comprises damping circuit 14. The damping circuit 14 is configured to attenuate high frequency oscillations in said operating voltage by drawing additional current upon the detection of a dimmer edge, i.e. at approximately 200 μs thereafter. The damping circuit 14 comprises a capacitor/resistor network (not shown) that is tuned to a resonance frequency of the dimmer in such a way, that the resistance of the network provided appropriate damping. To provide that the bleeder circuit 13 and the damping circuit 14 during operation draw additional current from the power supply 2 only, diodes 28 are arranged in the first supply connection 21*a*.

Besides the before mentioned components, circuit arrangement 1 further comprises a low voltage supply 27 to provide power for the circuit arrangement 1 and in particular for the operation of bleeder 13, dim level detector 20 and lamp current controller 19.

During operation, operating voltage is present at the supply terminals 10*a* and 10*b*. A corresponding current flows through the power shaping circuit 7, the lamp driver unit 8 and the LEDs 3. It is noted, that the second output terminal 12*b* and the negative sides of the current sources 15*a*-15*c* are connected to ground potential. Accordingly, the two resistors 23, 24, which form a voltage divider, provide that the voltage at the second supply terminal 10*b* of the input device 6 is "shifted" versus ground potential. As will be apparent, the shift in the voltage is dependent on the respective current. While the voltage over the first current sensing resistor 23 thus corresponds to the lamp current (and the current of damping circuit 14), the voltage at the second supply terminal 10*b* corresponds to the global current, i.e. including the current drawn by the bleeder circuit 13 and damping circuit 14.

Accordingly, the first feedback signal of first feedback circuit 18 corresponds to the momentary lamp current and the second feedback signal of the second feedback circuit 25 corresponds to the global current. The present embodiment of circuit arrangement 1 thus allows to determine both, the lamp current and the global current simultaneously with a cost-effective circuit design and in particular without the losses of a current measurement in series with the LEDs 3, i.e. in the part of the circuit arrangement 1, where relatively high currents are present during operation.

Figure 2:
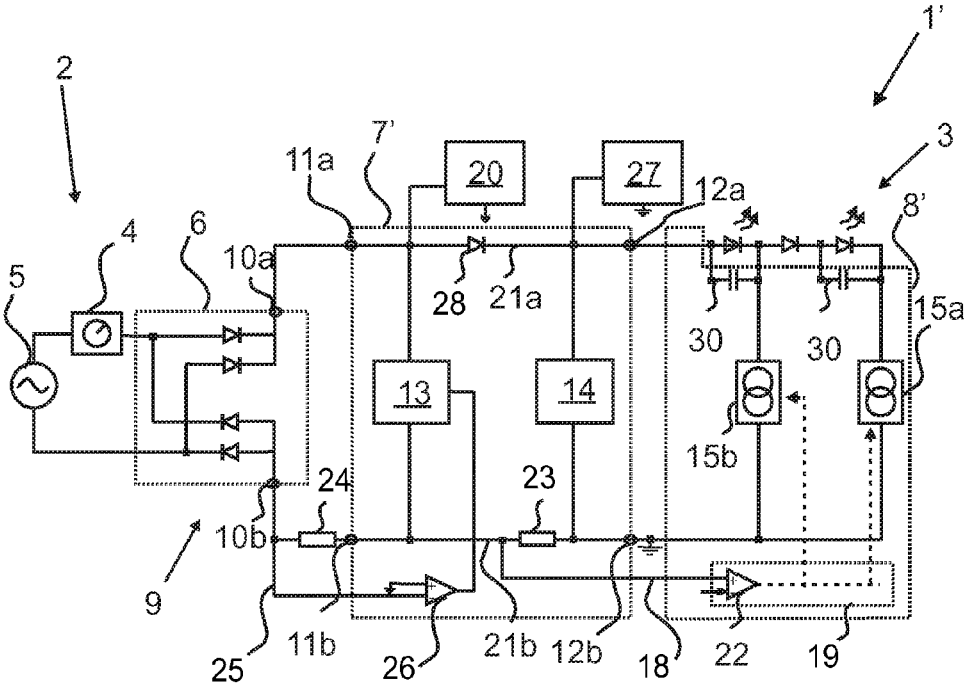
FIG. 2 illustrates a second embodiment of the circuit arrangement in a schematic block diagram.

FIG. 2 shows a second embodiment of the inventive circuit arrangement 1'. The embodiment of FIG. 2 corresponds in general to the embodiment of FIG. 1 with the exception of power shaping circuit 7' and the lamp driver unit 8'.

According to the present embodiment, lamp driver unit 8' comprises two capacitors 30 in parallel to the LEDs 3 instead of the aforementioned "fill-in" capacitor 16 and the combination of current source 15*c* and switch 17, thus providing a reduced complexity of the setup of circuit arrangement 1'. The capacitors 30 according to the present embodiment serve to as energy storage or buffer, in case the provided voltage is too low to power the LEDs 7, i.e. close to the zero-crossing in each half cycle of the alternating phase-cut operating voltage.

Power shaping circuit 7' comprises bleeder circuit 13 and damping circuit 14, however here, damping circuit 14 is directly connected to the second output terminal 12*b* and thus ground potential. The changed setup provides that any current drawn by the damping circuit 14 is advantageously included in the first feedback signal of feedback circuit 18. Accordingly, it is possible to more precisely control the global current to the predefined minimum load current (at about 1% flatness).

Figure 3:
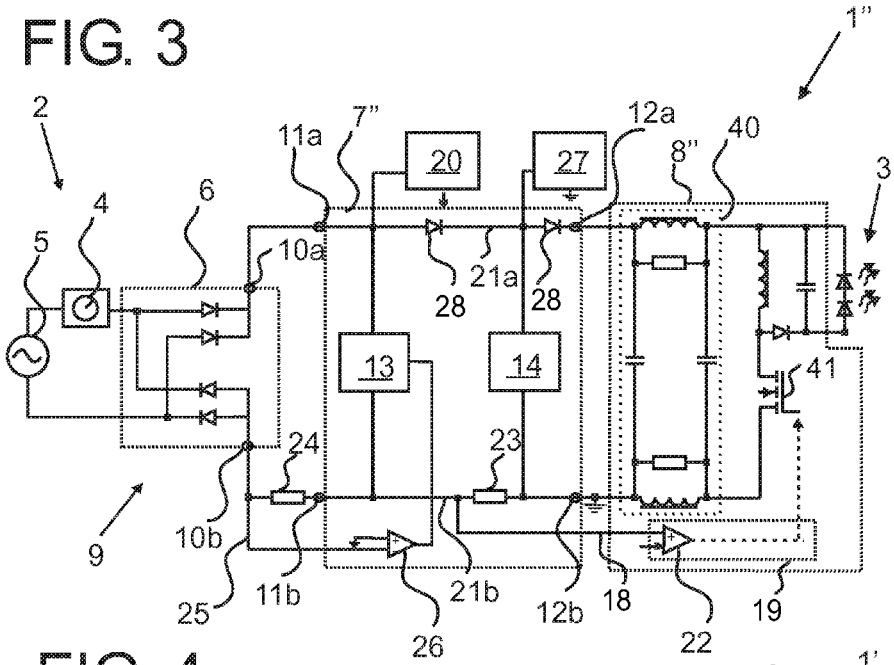
FIG. 3 illustrates a third embodiment of the inventive circuit arrangement in a further schematic block diagram.

A third embodiment of circuit arrangement 1" is shown in FIG. 3. The embodiment corresponds to the embodiment of FIG. 2 with the exception that the setup of the lamp driver unit 8" corresponds to a switching mode power supply (SMPS) with a MOSFET switch 41. Further, power shaping circuit 7" comprises two diodes 28 in the first supply connection 21*a*, according to the embodiment of FIG. 1. As shown, the setup of driver unit 8" corresponds to a buck boost SMPS. The driver unit 8" further comprises an EMI-filter 40 so that the high-frequency switching of switch 41 does not interfere with the operation of bleeder circuit 13 and damping circuit 14.

Figure 4:
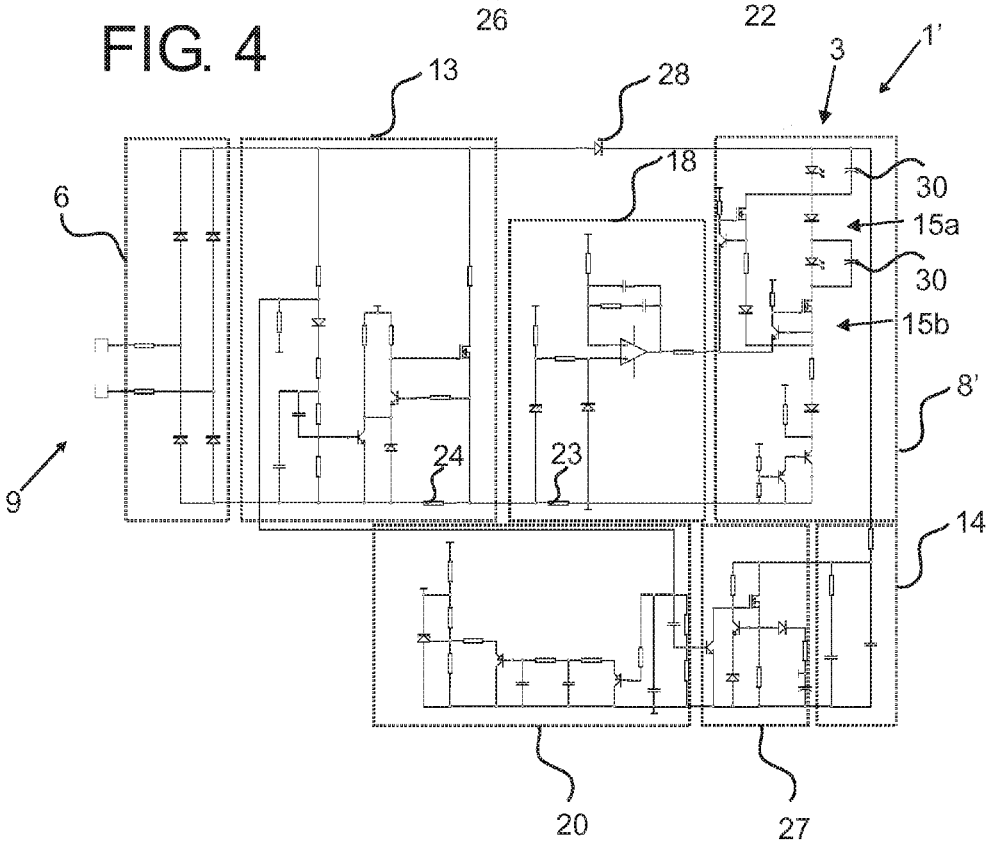
FIG. 4 illustrates the embodiment of FIG. 2 in a detailed circuit diagram and FIG. 5*a* illustrates a further embodiment of the circuit arrangement according to the invention in a schematic circuit diagram and FIG. 5*b* shows the embodiment of FIG. 5*a* in a more detailed circuit diagram.

FIG. 4 illustrates the embodiment of FIG. 2 in a detailed circuit diagram, but without the power supply 2. As can be seen, the bleeder circuit 13 comprises a current source with a FET, operated in linear mode. In this example, the current source is controlled between two levels, dependent on the rectified mains voltage. Accordingly, a low ohmic path is realized during the OFF state of the dimmer 4.

The second feedback circuit 25 is connected to second current sensing resistor 24 and is furthermore connected to a low voltage transistor of the bleeder circuit 13.

The circuit arrangement 1' further comprises first feedback circuit 18, which is realized using an OP-AMP over said first current sensing resistor 23. At the input of the OP-AMP, a clamping diode is arranged to prevent negative voltages. The current through the sensing resistor 23 is clamped to a predefined reference value.

The lamp driver unit 8' comprises a power stage based on a tapped liner driver, as mentioned in the preceding, and comprises two high voltage LEDs 3 or two strings of LEDs 3. Each LED 3 has a corresponding electrolytic capacitor 30 in parallel. The shown two controllable current sources 15*a*, 15*b* are attached to each LED 3 providing power in dependence of the input voltage said current sources 15*a*, 15*b* switch. The actual amplitude during the mains cycle of the current sources is controlled by said OP-AMP.

The dim level detector 20 provides a reference voltage as a function of the phase-cut angle of the dimmer 4, i.e. the rectified mains. Low voltage supply 27 provides a constant low voltage of 12V to power the circuit arrangement 1'. The damping circuit 14 is formed as a passive R-C latch.

Figure 5A:
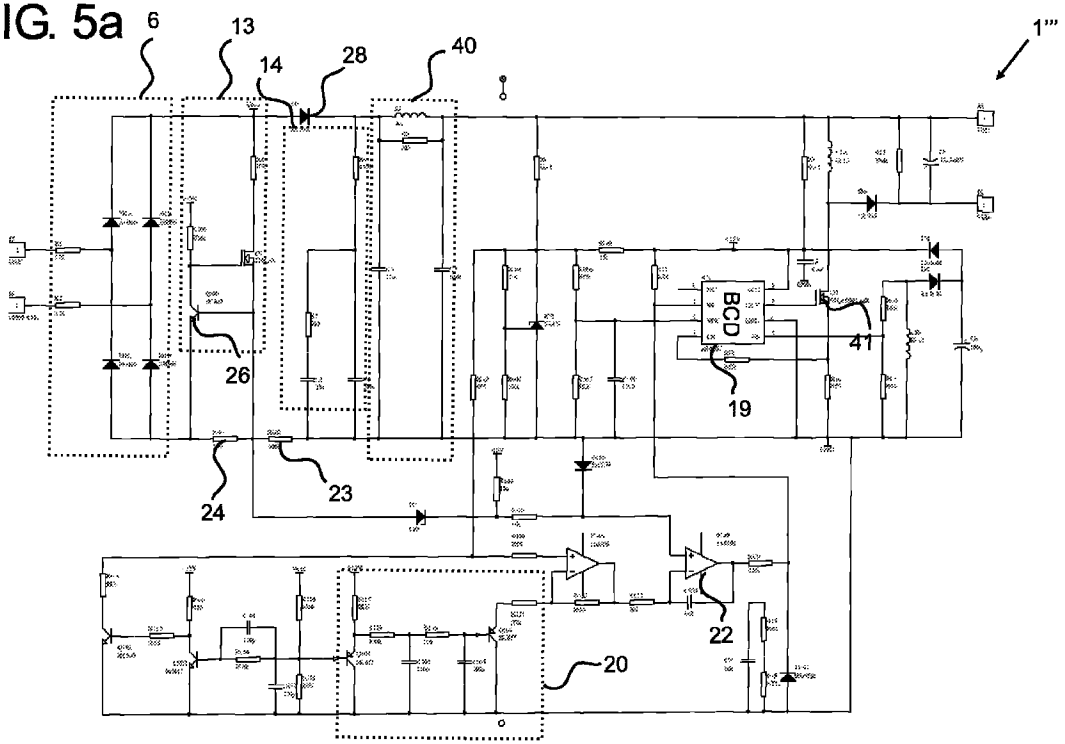
Figure 5B:
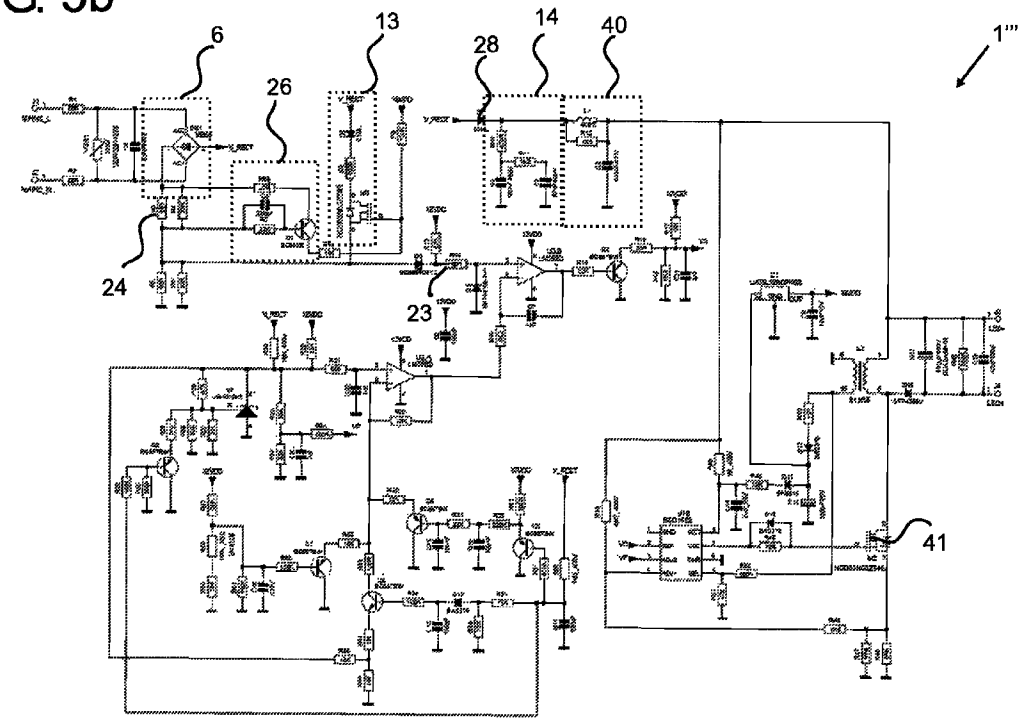

FIGS. 5*a* and 5*b* illustrate a further embodiment of the circuit arrangement 1'" according to the invention in a further detailed circuit diagram. The present embodiment shows a setup of a circuit arrangement 1'" in a switch mode power supply buck-boost configuration, but without LEDs 3. The circuit arrangement 1'" comprises a non-dimmable IC AP1682 from BCD and a MOSFET switch. This embodiment comprises the building blocks described above, as can be seen from FIGS. 5*a* and 5*b*. For said first and second feedback circuits 18, 25, two OP-AMPs have been used.

While the invention has been illustrated and described in detail in the drawings and foregoing description, such illustration and description are to be considered illustrative or exemplary and not restrictive; the invention is not limited to the disclosed embodiments. For example, it may be possible to operate the invention in an embodiment in which:

a different number of LEDs 3 is present, the LEDs 3 have a higher or lower power, the circuit arrangement 1, 1', 1", 1''' comprises circuitry to improve/flatten line regulation, e.g. by using further feedback loops, the circuit arrangement 1, 1', 1", 1''' comprises over power and/or temperature protection circuitry, the first feedback circuit 18 and/or the second feedback circuit 25 are formed as part of an integrated circuit and/or in the embodiment of FIG. 3, instead of a buck boost converter setup, a buck, a tapped buck, fly-back or half bridge setup is used.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An apparatus configured to supply a lamp current to at least one lighting unit, the apparatus comprising:

an input device for connection to a power supply to receive a phase-cut operating voltage from the power supply, the input device having at least a first supply terminal and a second supply terminal a two-port power shaping circuit, including:

a first input terminal and a second input terminal, connected with the respective supply terminals of said input device, a first output terminal and second output terminal, connected with said input terminals over first and second supply connections, a controllable bleeder circuit, connected with said first and second input terminals to provide an alternative current path between said input terminals and being configured to set a level of a total current drawn from the power supply during operation to be at least a predetermined minimum load current, and a damping circuit, connected to said first and second supply connections at a first connection point and a second connection point to attenuate high frequency oscillations in the phase-cut operating voltage; and a lamp driver unit, connected to at least one of the output terminals of the power shaping circuit and being configured for connection to said at least one lighting unit, said lamp driver unit comprising:

a lamp current controller, configured to set the lamp current of said at least one lighting unit, and a first feedback circuit, configured to provide a first feedback signal, corresponding to the momentary lamp current of said at least one lighting unit, wherein the lamp current controller is connected with said first feedback circuit to control the lamp current in dependence of said first feedback signal, so that the lamp current corresponds to a predetermined setpoint current, and wherein the controllable bleeder circuit is configured to set the level of the total current drawn from the power supply during operation to be at least the predetermined minimum load current independently of the control of the lamp current.

2. The apparatus of claim 1, wherein said controllable bleeder circuit is controlled to provide the alternative current path between the input terminals only when a current drawn by the lamp driver unit and the at least one lighting unit from the power supply during operation is less than said predetermined minimum load current.

3. The apparatus of claim 1, wherein the input device comprises a full-bridge rectifier, wherein a positive output of said rectifier is connected to said first supply terminal and a negative output of said rectifier is connected to said second supply terminal.

4. The apparatus of claim 1, wherein said damping circuit is adapted, so that upon detection of a dimmer edge, the total current drawn from the power supply during operation is controlled to be an increased edge current, greater than said predetermined minimum load current.

5. The apparatus of claim 1, wherein a current flow restrictor is provided in said first supply connection between said first input terminal and said first connection point, the current flow restrictor being configured to restrict a current flow from the damping circuit to the bleeder circuit.

6. The apparatus of claim 1, further comprising a dim level detector, configured to determine a dim level from said phase-cut operating voltage, said dim level detector being connected with said lamp current controller to set the predetermined setpoint current in dependence of the determined dim level.

7. The apparatus of claim 1, further comprising the at least one lighting unit connected to said lamp driver unit, the at least one lighting unit including at least one light emitting diode (LED).

8. The apparatus of claim 7, further comprising the power supply, the power supply being configured to provide said LED lamp with the phase-cut operating voltage.

9. The apparatus of claim 1, wherein the damping circuit comprises a resistor-capacitor network tuned to a resonance frequency of a dimmer included in the power supply.

10. An apparatus configured to supply a lamp current to at least one lighting unit, the apparatus comprising:

an input device for connection to a power supply to receive a phase-cut operating voltage from the power supply, the input device having at least a first supply terminal and second supply terminal;

a two-port power shaping circuit, including:

a first input terminal and a second input terminal, connected with the respective supply terminals of the input device, a first and second output terminal, connected with the input terminals over first and second supply connections, a controllable bleeder circuit, connected with the first and second input terminals to provide an alternative current path between the input terminals and being configured to set a level of a total current drawn from the power supply during operation to be at least a predetermined minimum load current, and a damping circuit, connected to the first and second supply connections at a first connection point and a second connection point to attenuate high frequency oscillations in the phase-cut operating voltage; and a lamp driver unit, connected to at least one of the output terminals of the power shaping circuit and being configured for connection to the at least one lighting unit, the lamp driver unit comprising:

a lamp current controller, configured to set the lamp current of the at least one lighting unit, a first feedback circuit, configured to provide a first feedback signal, corresponding to the momentary lamp current of the at least one lighting unit, and a second feedback circuit, configured to produce a second feedback signal corresponding to the total current drawn from the power supply during operation, and to provide said second feedback signal to the controllable bleeder circuit, wherein the lamp current controller is connected with the first feedback circuit to control the lamp current in response to the first feedback signal, so that the lamp current corresponds to a predetermined setpoint current, and wherein the controllable bleeder circuit is configured to respond to the second feedback signal to set the level of the total current drawn from the power supply during operation to be at least the predetermined minimum load current independently of the control of the lamp current.

11. The apparatus of claim 10, wherein said first and second feedback circuit are coupled to a series connection of a first and a second current sensing resistor, said series connection being coupled between said second supply terminal and a reference potential.

12. The apparatus of claim 11, wherein said first feedback circuit is connected to a current sensing point between said first and second current sensing resistors to determine said first feedback signal.

13. The apparatus of claim 10, wherein the second feedback circuit is connected with said second supply terminal of said input device to determine said second feedback signal, corresponding to the total current drawn from the power supply.

14. The apparatus of claim 11, wherein said second output terminal of said power shaping circuit is connected to said reference potential, said first current sensing resistor is connected in series between said second input terminal and said second output terminal, and said second current sensing resistor is arranged in series between said second supply terminal and said second input terminal.

15. The apparatus of claim 11, wherein the lamp driver unit is connected between said first output terminal of the power shaping circuit and said reference potential.

16. A method of operating at least one lighting unit, the method comprising;

receiving by an input device of an apparatus a phase-cut operating voltage from a power supply, the input device having at least a first supply terminal and a second supply terminal, connecting a first input terminal and a second input terminal of a two-port power shaping circuit of the apparatus with the respective supply terminals of said input device, connecting a first output terminal and a second output terminal with said input terminals over first and second supply connections, connecting a controllable bleeder circuit with said first and second input terminals to provide an alternative current path between said input terminals connecting a damping circuit to said first and second supply connections to attenuate high frequency oscillations in said phase-cut operating voltage, and connecting a lamp driver unit to at least one of the output terminals of the power shaping circuit, the lamp driver unit being configured for connection to said at least one lighting unit to supply a lamp current to the at least one lighting unit, producing a first feedback signal corresponding to the momentary lamp current of the at least one lighting unit, the bleeder circuit setting a level of a total current drawn from the power supply during operation to be at least a predetermined minimum load current, and the lamp driver unit controlling the lamp current in response to the first feedback signal, so that the lamp current corresponds to a predetermined setpoint current, wherein the bleeder circuit is configured to set the level of the total current drawn from the power supply during operation to be at least the predetermined minimum load current independently of the control of the lamp current.

17. The method of claim 16, further comprising:

producing a second feedback signal, corresponding to the total current drawn from the power supply during operation;

providing the second feedback signal to the controllable bleeder circuit; and the controllable bleeder circuit responding to the second feedback signal to set the level of the total current drawn from the power supply during operation to be at least the predetermined minimum load current independently of the control of the lamp current.

18. The method of claim 17, wherein the controllable bleeder circuit is controlled to provide the alternative current path between the input terminals only when a current drawn by the lamp driver unit and the at least one lighting unit from the power supply during operation is less than the predetermined minimum load current.

19. The method of claim 16, wherein the lamp driver unit controlling the lamp current in response to the first feedback signal so that the lamp current corresponds to a predetermined setpoint current comprises:

detecting a dimming level of the phase-cut operating voltage and in response thereto generating a dim signal corresponding to the predetermined setpoint current;

comparing the first feedback signal, corresponding to the momentary lamp current of the at least one lighting unit, to the dim signal corresponding to the predetermined setpoint current; and controlling the lamp current in response to the comparison.

20. The method of claim 16, further comprising a user setting the predetermined minimum load current by a user interface of the apparatus.

* * * * *